US005639221A

United States Patent [19]

Siebenwurst

[11] Patent Number: 5,639,221

[45] Date of Patent: Jun. 17, 1997

[54] LIQUID RING COMPRESSOR WITH SIDE SHIELD LOCATED INLET SEPARATOR

[75] Inventor: Robert Siebenwurst, Nuremberg, Germany

[73] Assignee: Siemens Aktiengesellschaft, Munich, Germany

[21] Appl. No.: 689,977

[22] Filed: Aug. 16, 1996

[30] Foreign Application Priority Data

Aug. 21, 1995 [DE] Germany ..... 195 30 665.1

[51] Int. Cl.[6] ..... F04C 19/00

[52] U.S. Cl. ..... 417/68; 417/313; 55/467

[58] Field of Search ..... 417/68, 69, 312, 417/313; 55/467, 471

[56] References Cited

U.S. PATENT DOCUMENTS

| | | | |
|---|---|---|---|
| 1,622,250 | 3/1927 | Jennings | 417/68 |
| 3,771,898 | 11/1973 | Segebrecht | 417/68 |
| 4,392,783 | 7/1983 | Jozepaitis | 417/68 |
| 4,498,844 | 2/1985 | Bissell | 417/68 |
| 4,710,105 | 12/1987 | Segebrecht et al. | 417/68 |
| 4,756,672 | 7/1988 | Trimborn . | |
| 5,009,782 | 4/1991 | Trimborn . | |

FOREIGN PATENT DOCUMENTS

| | | | |
|---|---|---|---|
| 27 04 863 | 8/1978 | Germany . | |
| 36 17 344 | 11/1988 | Germany . | |
| 0 392 034 | 4/1989 | Germany . | |
| 63-186985 | 8/1988 | Japan | 417/68 |

*Primary Examiner*—Timothy Thorpe
*Assistant Examiner*—Roland G. McAndrews, Jr.
*Attorney, Agent, or Firm*—Kenyon & Kenyon

[57] ABSTRACT

A liquid ring compressor comprising at least one side shield having a suction connection leading to a suction chamber and a discharge connection leading to a pressure chamber. A cam disk spatially delimits the suction and pressure chambers from the working chamber of the liquid ring compressor. The cam disk comprises a suction slot that establishes fluid-flow communication between the suction chamber and the working chamber and a delivery slot that establishes fluid-flow communication between the pressure chamber and the working chamber. A separating and quieting configuration is provided in the suction chamber to separate and settle a portion of liquid from a drawn-in gas-liquid mixture so that the separated liquid may be removed from the suction chamber. The removal of a portion of the liquid prevents compressor performance from decreasing.

11 Claims, 2 Drawing Sheets

LIQUID RING COMPRESSOR WITH SIDE SHIELD LOCATED INLET SEPARATOR

FIELD OF THE INVENTION

The invention relates generally to liquid ring compressors. In particular, the invention relates to liquid ring compressors comprising at least one side shield that has a suction connection that leads to a suction chamber and a discharge connection that leads to a pressure chamber. A cam disk is located between the side shield and compressor housing and delimits the suction and pressure chambers from the working chamber of the liquid ring compressor. The cam disk is provided with a suction slot to establish fluid communication between the suction chamber and the working chamber. The cam disk is also provided with a delivery slot to establish fluid flow communication between the pressure chamber and the working chamber.

BACKGROUND OF THE INVENTION

Liquid ring compressors of this general type are described in U.S. Pat. No. 5,009,782, the contents of which are incorporated herein by reference.

When a gas-liquid mixture is drawn into a liquid ring compressor, a large quantity of liquid is frequently drawn in to the suction chamber with the gas to be compressed. The drawn-in liquid reaches the working chamber of the compressor in addition to the normal operating fluid. As a rule, liquid ring compressors are designed only to deliver a small additional quantity of liquid. Furthermore, when designing the liquid ring compressor the quantity of liquid to be delivered is usually unknown, which makes it difficult to specially design a liquid ring compressor to deliver a larger quantity of liquid. The presence of a large quantity of liquid in the liquid ring compressor impairs compressor performance and increases power requirements.

The objective of this invention is to provide a liquid ring compressor of this general type in which the performance of the liquid ring compressor remains unimpaired regardless of the quantity of liquid contained in a gas-liquid mixture drawn in by the compressor.

SUMMARY OF THE INVENTION

The objective is achieved by providing a separating and quieting means to separate a portion of the liquid from a drawn-in gas-liquid mixture and to settle the separated liquid. Quieting the separated liquid prior to removal from the liquid ring compressor is necessary to prevent gas from being removed as well. Due to the liquid separation in the suction chamber, the liquid quantity that enters the working chamber with the gas is reduced to a value that does not adversely affect the performance of the compressor. Except for the suction chamber, the remaining parts of the compressor can be designed with the assumption that the liquid ring compressor will deliver only a small amount of liquid. The separated and quieted liquid is removed from the liquid ring compressor through a suction-off opening located at the bottom of the suction chamber.

The separating and quieting of the liquid removed from the gas-liquid mixture (which is necessary for proper removal by suction) is achieved in a simple manner by at least one wall section that extends parallel to the plane of the cam disk toward an adjacent wall and leaves open a passage gap; this is arranged as a separating and quieting means in the area of the suction chamber downstream of the suction slot in relation to the direction of rotation of the impeller.

The wall section has a triangular cross-section and is arranged on a partition wall, which separates the suction chamber from the pressure chamber. One wall side of the triangular wall section slopes downward (i.e., gravitationally downward in a geodetic sense). The wall section is easily constructed, and the sloped wall section helps drain the separated liquid.

The suction-off opening is located in the region of the suction chamber that is downstream of the wall section in relation to the direction of rotation of the impeller. The separated liquid is least agitated in this region so that when the separated liquid is removed from the liquid ring compressor by suction no gas is removed.

DETAILED DESCRIPTION

Figure 1:
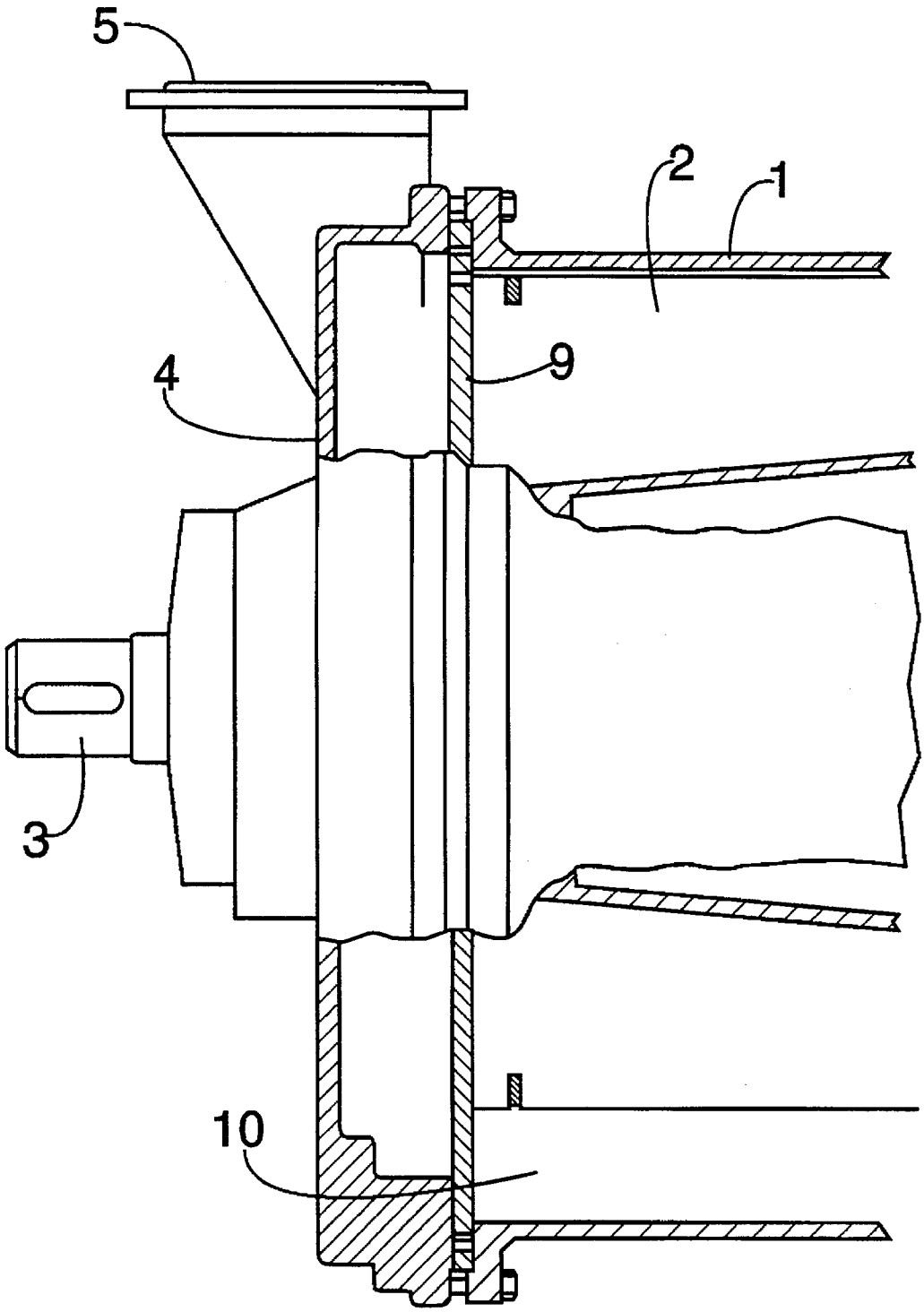
FIG. 1 is a partial longitudinal cross-sectional side view of a liquid ring compressor constructed according to the principles of this invention.
Figure 2:
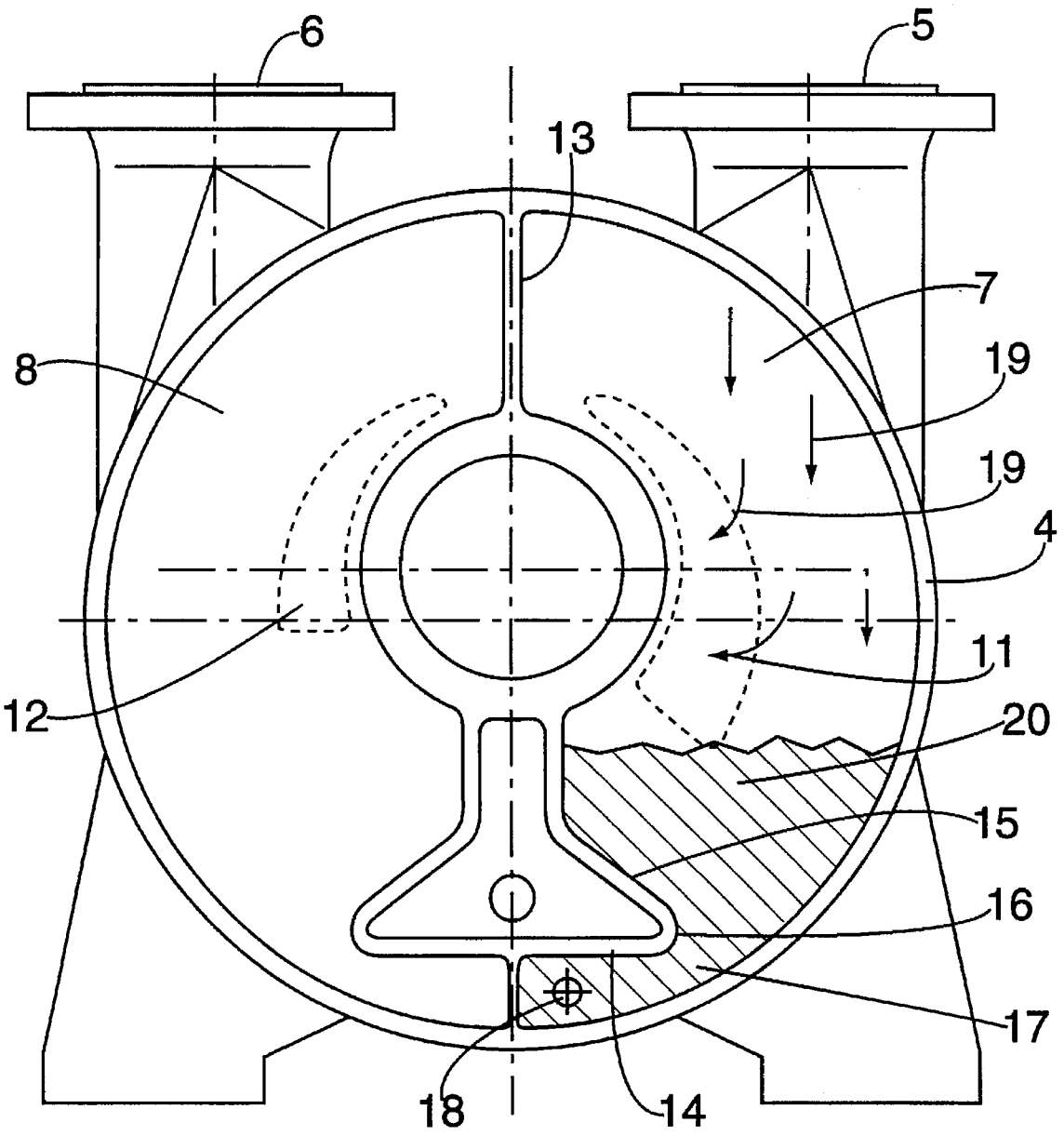
FIG. 2 is a partially cut-away plan view of the liquid ring compressor shown in FIG. 1.

As shown in FIG. 1, an impeller 2 is located inside housing 1 of the liquid ring compressor. The impeller 2 is eccentrically offset from the center axis of the compressor housing 1. A side shield 4 is provided on each end face of the compressor housing 1. The shaft 3 of the impeller 2 is rotationally mounted in the side shields 4. A suction connection 5 and a discharge connection 6 (see FIG. 2) are pre-molded on each side shield 4. As shown in FIG. 2, the suction connection 5 leads to a suction chamber 7 formed in each side shield 4, and the discharge connection 6 correspondingly leads to a pressure chamber 8. A partition wall 13 separates both chambers from each other so that the pressure in one chamber does not affect the pressure in the other chamber.

As shown in FIG. 1, a cam disk 9 is inserted in known manner between each side shield 4 and end face of the compressor housing 1. The cam disk 9 spatially delimits the suction chamber 7 and the pressure chamber 8 from the working chamber 10 of the compressor housing 1.

The cam disk 9 has one suction slot 11 and one delivery slot 12. The suction slot 11 establishes fluid-flow communication between the suction chamber 7 and the suction region of the working chamber 10. Delivery slot 12 establishes fluid communication between the pressure chamber 8 and the compression region of the working chamber 10.

As shown in FIG. 2, a wall section 14 having a triangular cross-section is pre-molded on the partition wall 13 and projects into the suction chamber 7. For reasons of symmetry, another wall section projects into the pressure chamber 8 and is provided on the partition wall 13. The wall section 14 has a wall side 15 sloping downwards geodetically. Apart from that, the wall section 14 extends parallel to the plane of the cam disk 9. A passage gap 17 is formed between the triangular point 16 of the wall section 14 and the wall of the compressor housing 1. A suction-off opening 18 is provided in the side shield geodetically below the wall section 14.

A gas-liquid mixture enters the suction chamber 7 of the liquid ring compressor and follows arrows 19. A portion of the liquid that enters is separated from the mixture in the suction chamber 7. The separated liquid 20 collects in the lower region of the suction chamber 7. Wall section 14 separates the liquid from the gas-liquid mixture and quiets the separated liquid. Consequently, the liquid 20 accumulating in the suction chamber 7 can be pumped out via the suction-off opening 18 without gas from the gas-liquid mix also being pumped out at the same time.

Due to the separation of liquid from the gas-liquid mixture, the quantity of liquid that reaches the working chamber 10 of the compressor is reduced to a value that does not negatively influence compressor performance. Hence, apart from the presence of a side shield, the liquid ring compressor can be designed with the assumption that the liquid ring compressor delivers only a small quantity of liquid.

What is claimed is:

1. A liquid ring compressor comprising:

a working chamber;

an impeller located inside the working chamber; and at least one side shield having a suction connection and a discharge connection, the suction connection leading to at least one suction chamber and the discharge connection leading to at least one pressure chamber, the suction and pressure chambers being spatially delimited from the working chamber by a cam disk, the cam disk having a suction slot for establishing fluid communication between the suction chamber and the working chamber and a delivery slot for establishing fluid communication between the pressure chamber and the working chamber, wherein a separating and quieting means is provided in the suction chamber for separating at least a portion of liquid from a drawn-in gas-liquid mixture and for quieting the separated liquid collected in the suction chamber.

2. The liquid ring compressor according to claim 1, wherein the separating and quieting means comprises at least one wall section that extends parallel to the plane of the cam disk, and extends from the cam disk to the side shield, the wall section defining a constricted passage leading to a pocket that is located downstream of the suction slot in relation to the direction of rotation of the impeller.

3. The liquid ring compressor according to claim 2, wherein the wall section is arranged on a partition wall that separates the suction chamber from the pressure chamber, the wall section having a triangular cross-section, one wall side of the triangular wall section sloping downwards geodetically.

4. The liquid ring compressor according to claim 2, wherein a suction-off opening is provided in the region of the suction chamber that is downstream of the wall section in relation to the direction of rotation of the impeller.

5. The liquid ring compressor according to claim 2, wherein a suction-off opening is provided in the region of the suction chamber that is downstream of the wall section.

6. The liquid ring compressor according to claim 1, wherein the separating and quieting means comprises at least one wall section that extends parallel to the plane of the cam disk, and extends from the cam disk to the side shield, the wall section defining a constricted passage leading to a pocket that is located downstream of the suction slot.

7. A liquid ring compressor comprising:

a compressor housing having a center axis and end faces;

a working chamber arranged within the compressor housing;

an impeller located within the working chamber, the impeller being arranged eccentrically with respect to the center axis of the compressor housing;

a side shield being arranged on at least one end face of the compressor housing, the side shield having a suction connection and a discharge connection, the suction connection leading to at least one suction chamber and the discharge connection leading to at least one pressure chamber, the suction and pressure chambers being spatially delimited from the working chamber by a cam disk, the cam disk having a suction slot for establishing fluid communication between the suction chamber and the working chamber and a delivery slot for establishing fluid communication between the pressure chamber and the working chamber;

a partition wall arranged in the side shield that separates the suction chamber from the pressure chamber;

a wall section arranged on the partition wall and inside the suction chamber; and a liquid drain arranged below the wall section, wherein the wall section separates liquid from a medium to be compressed and quiets the separated liquid such that the separated liquid is removed through the liquid drain.

8. The liquid ring compressor according to claim 7, wherein the wall section has a triangular-cross section.

9. The liquid ring compressor according to claim 8, wherein the wall section has a wall side that slopes downward geodetically.

10. The liquid ring compressor according to claim 8, wherein a passage is formed between a triangular point of the wall section and an inside wall of the compressing housing.

11. The liquid ring compressor according to claim 7, wherein the wall section is premolded onto the partition wall.

* * * * *